US008876338B2

(12) United States Patent
Trudel et al.

(10) Patent No.: US 8,876,338 B2
(45) Date of Patent: Nov. 4, 2014

(54) DRIVEWAY MARKING DEVICE

(71) Applicants: Sandra L. Trudel, Lorette (CA); Mitchell Levy, Kirkland, WA (US)

(72) Inventors: Sandra L. Trudel, Lorette (CA); Mitchell Levy, Kirkland, WA (US)

( * ) Notice: Subject to any disclaimer, the term of this patent is extended or adjusted under 35 U.S.C. 154(b) by 120 days.

(21) Appl. No.: 13/726,060

(22) Filed: Dec. 22, 2012

(65) Prior Publication Data

US 2013/0279178 A1 Oct. 24, 2013

Related U.S. Application Data

(60) Provisional application No. 61/625,965, filed on Apr. 18, 2010.

(51) Int. Cl.

| | |
|---|---|
| ***F21V 7/00*** | (2006.01) |
| ***E01F 13/02*** | (2006.01) |
| ***E01F 9/015*** | (2006.01) |
| *F21W 111/02* | (2006.01) |
| *F21W 121/00* | (2006.01) |
| *F21S 4/00* | (2006.01) |
| *F21V 21/08* | (2006.01) |
| *F21W 131/109* | (2006.01) |

(52) U.S. Cl.

CPC ..... *F21V 7/00* (2013.01); *F21W 2111/02* (2013.01); *F21W 2121/00* (2013.01); *F21S 4/001* (2013.01); *E01F 13/028* (2013.01); *F21V 21/0824* (2013.01); *E01F 9/015* (2013.01); *F21W 2131/109* (2013.01)

USPC ..... 362/341; 362/431

(58) Field of Classification Search

USPC ..... 362/341, 431, 433

See application file for complete search history.

(56) References Cited

U.S. PATENT DOCUMENTS

| | | | |
|---|---|---|---|
| 3,066,577 | A | 12/1962 | Gunderson |
| 3,716,288 | A | 2/1973 | Kannenberg |
| 3,802,378 | A | 4/1974 | Kessler |
| 5,052,329 | A | 10/1991 | Bennett |

*Primary Examiner* — Vip Patel

(74) *Attorney, Agent, or Firm* — Ryan W. Dupuis; Kyle R. Satterthwaite; Ade & Company Inc.

(57) ABSTRACT

A marking device includes a frame which supports a reflector member therein for being supported on a stake to be penetrated into the ground, for example for marking driveways. The frame is operable between open and closed positions to readily release the reflector member therefrom. Several frames can be stacked on a common stake by modular interconnection between adjacent frames in which some frame may support reflectors and other frames are suitable for retaining a cable extending therethrough. In this instance when a plurality of marking devices are penetrated into the ground at spaced positions in a row, a common cable, for example an electrical extension cord or a string of lights can be threaded through empty frames in the row to be supported spaced above the ground.

17 Claims, 5 Drawing Sheets

10

DRIVEWAY MARKING DEVICE

This application is claims the benefit under 35 U.S.C. 119(e) of U.S. provisional application Ser. No. 61/625,965, filed Apr. 18, 2012.

FIELD OF THE INVENTION

The present invention relates to a marking device for supporting a reflector member on a stake penetrated into the ground, for example for marking driveways; and more particularly, the present invention relates to a marking system comprising a plurality of marking devices providing additional functions of releasably supporting the reflector member thereon, modular stacking with other devices of like configuration, or retaining a cable supported through a plurality of marking devices spaced apart along the ground.

BACKGROUND

Reflectors are commonly available in moulded plastic frames which include a socket formed therein to receive the top end of a stake. The stake can be penetrated into the ground at the edge of a driveway or other suitable locations for marking purposes, for example to assist a driver of a vehicle in locating the driveway edge while navigating a vehicle into or out of the driveway.

Examples of marking devices which support a reflector on a ground penetrating stake are disclosed in U.S. Pat. No. 3,066,577 by Gunderson; U.S. Pat. No. 3,716,288 by Kannenberg; U.S. Pat. No. 3,802,378 by Kessler; and U.S. Pat. No. 5,052,329 by Bennett. In each instance the reflectors are permanently mounted within their respective frames which prevents the frames from being used for other purposes.

SUMMARY OF THE INVENTION

According to one aspect of the invention there is provided a marking device for use with a reflector member, the device comprising:

a stake member which is elongate between a top end and a bottom end arranged for penetration into the ground; and a frame comprising:

a lower portion arranged to be supported on the top end of the stake member; and an upper portion arranged to be coupled to the lower portion such that the upper portion is movable relative to the lower portion between a closed position in which each of the lower portion and the upper portion extend partway about a periphery of a mounting aperture in the frame so as to be arranged to fully surround and retain the reflector member therein and an open position in which the mounting aperture is opened so as to be arranged to readily release the reflector member therefrom.

By forming the frame to include upper and lower portions movable relative to one another, the reflector member can be readily released from the frame. The frame can thus be used for other purposes, for example supporting a cable member such as an extension cord extending through the mounting aperture otherwise occupied by the reflector member. Also the reflector member can be readily interchanged with other reflector members of different colour or configuration if desired.

Preferably the lower portion and the upper portion of the frame are coupled by a hinge such that the upper portion is pivotal relative to the lower portion between the open and closed positions.

Preferably a latch is arranged to selectively couple the upper portion to the lower portion at a location diametrically opposite from the hinge in relation to the mounting aperture.

Preferably the latch includes a finger member integrally moulded with one of the upper and lower portions of the frame which includes a first mating hook surface thereon, and the other one of the upper and lower portions of the frame includes a second mating hook surface thereon arranged to be latched in relation to the first mating hook surface in the closed position.

Preferably the finger member is resilient so as to be arranged to release the first and second mating hook surfaces from one another by flexing the finger member.

Preferably each of the lower portion and the upper portion are generally U-shaped about the mounting aperture.

When the mounting aperture is circular, preferably each of the lower portion and the upper portion are generally semi-circular in shape about the mounting aperture.

When used in combination with a reflector member which is circular, preferably each of the lower portion and the upper portion of the frame comprises a central section having a first radius of curvature which is substantially equal to a radius of the reflector member. Each of the lower portion and upper portion also preferably include a pair of side sections spaced apart by a thickness of the reflector member along respective sides of the central section and having respective second radii of curvature which are less than the first radius of curvature so as to retain the reflector member aligned with the central sections of the upper and lower portions of the frame in the closed position.

Preferably the marking device further comprises: i) the lower portion including a socket formed therein arranged to matingly receive the top end of the stake member therein; ii) the top portion including a post integrally formed thereon so as to be substantially coaxial with the socket in the closed position; iii) the post being arranged to be matingly received within the socket of an auxiliary frame of like configuration; and iv) the post being sized relative to the socket for an interference fit therebetween such that the post is arranged to be retained within the socket of an auxiliary frame of like configuration wholly by friction of the mating connection therebetween.

When a plurality of marking devices of like configuration are mounted at spaced apart positions in the ground and a cable member extends through the mounting apertures of the frames respectively, preferably each marking device further comprises: i) a retainer aperture extending fully through the frame between opposing sides thereof which is independent of the mounting aperture; and ii) a flexible tie member extending through the retainer aperture of each frame and being secured in a loop receiving the cable member therethrough.

Preferably the stake member further comprises a main body extending in a longitudinal direction between the top and bottom ends of the stake member and a pair of step flanges supported on the main body in proximity to the bottom end so as to project radially outward from the main body in relation to the longitudinal direction in which the step flanges each comprise a flat plate having a top edge lying in a substantially common plane with the other flat plate and a bottom edge arranged for penetration into the ground, and in which the flat plates are oriented transversely to one another.

According to a second aspect of the present invention there is provided a marking device for use with a reflector member, the device comprising:

a stake member which is elongate between a top end and a bottom end arranged for penetration into the ground; and a frame comprising:

a mounting aperture therein arranged to receive the reflector member therein such that the frame is arranged to fully surround and retain the reflector member therein;

a socket formed at a bottom side of the frame and arranged to matingly receive the top end of the stake member therein; and a post integrally formed at a top side of the frame so as to be substantially coaxial with the socket;

the post being arranged to be matingly received within the socket of an auxiliary frame of like configuration; and the post being sized relative to the socket for an interference fit therebetween such that the post is arranged to be retained within the socket of an auxiliary frame of like configuration wholly by friction of the mating connection therebetween.

In this arrangement, a plurality of frames can be readily stacked on a single stake member without any special modification or additional mounting hardware being required. Accordingly one mounting frame can be used for supporting a first reflector member therein, while another mounting frame can be used to support an additional reflector member at a different angular orientation. Alternatively a cable member such as an extension cord can be supported to extend through the second mounting frame.

Preferably the post and the socket have a non-circular cross-section such that the post is arranged to mate non-rotatably with the socket of the auxiliary frame.

Preferably the post is arranged to be matingly received within the socket of an auxiliary frame of like configuration for relative sliding movement in an axial direction wherein the post and the socket of the frame have respective transverse apertures extending fully therethrough transversely to the axial direction so as to be arranged to receive a retainer pin through the post and the socket so as to retain the post within the socket of an auxiliary frame of like configuration.

According to a further aspect of the present invention there is provided a marking system comprising:

a plurality of marking devices of like configuration mounted at spaced apart positions in the ground, each marking device comprising:

a stake member which is elongate between a top end and a bottom end arranged for penetration into the ground;

a frame comprising:

a mounting aperture; and a retainer aperture extending fully through the frame between opposing sides thereof which is independent of the mounting aperture; and a cable member extending through the mounting apertures of the frames respectively;

a plurality of flexible tie members extending through respective ones of the retainer apertures of the frames, each being secured in a loop receiving the cable member therethrough so as to fasten the cable member to the frame.

When used in combination with a plurality of circular reflector members, preferably each mounting aperture is arranged to receive a respective one of the reflector members such that the frame is arranged to fully surround and retain the reflector member therein interchangeably with the cable member.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 2:
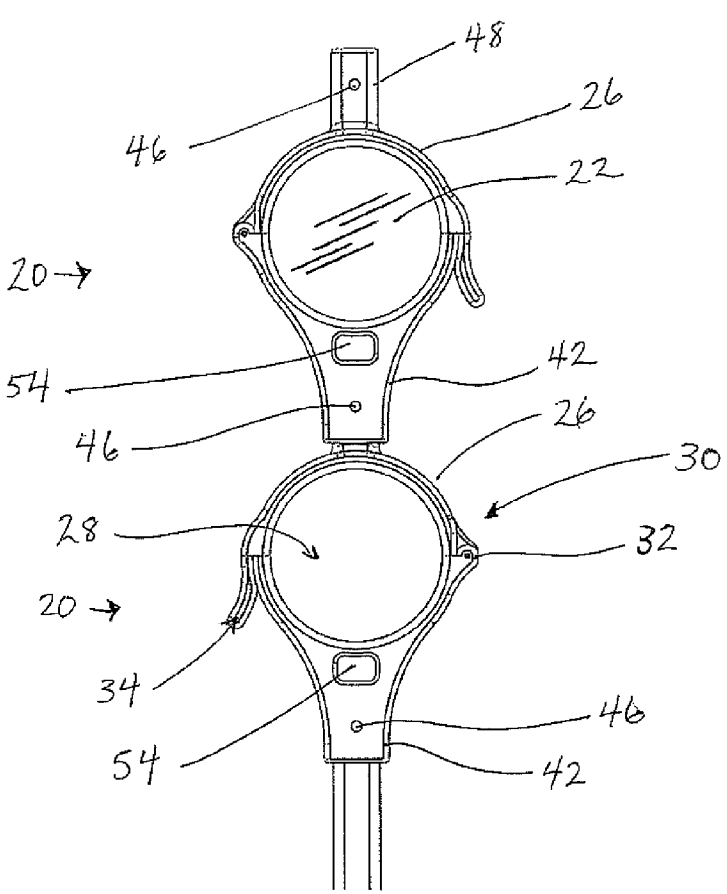
FIG. 2 is an enlarged front elevational view of the two frames of FIG. 1.
Figure 1:
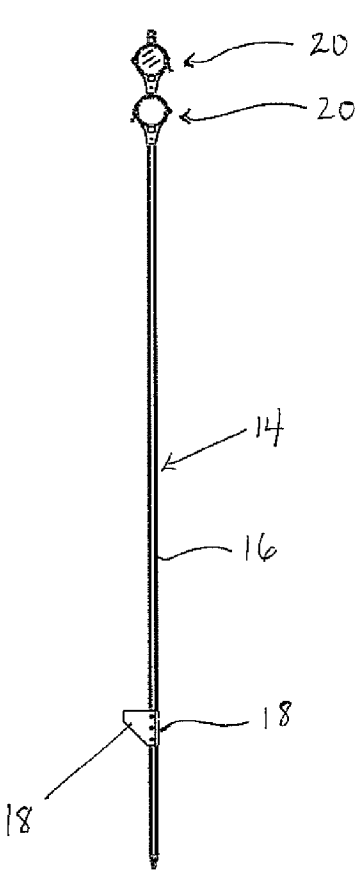
FIG. 1 is a front elevational view of two frames stacked on a stake member of a marking device.

Referring to the accompanying figures, there is illustrated a marking device generally indicated by reference numeral 10. A plurality of the devices 10 can be used together as a marking system to provide the dual function of marking an edge of a pathway, for example a driveway, as well as supporting a cable member 12 along the marked edge, for example a string of lights or an electrical cord.

Each marking device 10 includes a stake member 14 having a main body 16 which is elongate in a longitudinal direction between opposing top and bottom ends. The stake member is square in cross section. The bottom end is tapered towards a pointed apex so as to be suitable for ready penetration into the ground.

The stake member further includes two step flanges 18 mounted in proximity to the bottom end, but spaced upwardly therefrom to assist in penetrating the stake into the ground by providing a stepping surface upon which a user can step. The two step flanges each comprise a flat plate mounted flat against a corresponding side of the square cross section of the main body such that the two flanges 18 extend generally radially outward from the longitudinal direction of the main body perpendicularly to one another. The top edges of the step flanges lie in a common plane which is perpendicular to the longitudinal direction while the bottom edges are sloped downwardly and inwardly in the radial direction towards the main body for ease of penetration into the ground.

Each device 10 includes at least one frame 20 supported thereon in which each of the frames is arranged to receive a reflector member 22 therein. The reflector members comprise commercially available reflectors which are circular and flat in shape, typically moulded of plastic material in layers with a multi-faceted layer to enhance the reflective qualities of the material.

The frame includes a lower portion 24 and an upper portion 26 which are arranged to be assembled with one another to form an annular body about a central mounting aperture 28 which is also circular so as to be arranged to receive and retain a reflective member 22 optionally therein. Each of the upper and lower portions is generally U-shaped so as to be semi-circular and extend at least part way about a circumference or periphery of the mounting aperture. When assembled with one another in a closed position the upper and lower portions together fully surround the mounting aperture and any reflector member 22 received therein.

The upper portion and the lower portion are coupled to one another by a hinge 30 at one side of the frame. Knuckles of the hinge 30 are integrally moulded with each of the upper and lower portions of the frame to permit a hinge pin 32 to be received through respective apertures in the knuckles. The upper and lower portions are thus pivotal relative to one another between the closed position fully surrounding the mounting aperture such that the reflector member is retained within the mounting aperture and an open position in which the mounting aperture is opened such that the reflector member is readily releasable from the frame. The upper portion is pivotal relative to the lower portion about an axis which is parallel to a central axis of the circular mounting aperture and frame while being perpendicular to the longitudinal direction of the stake member in the assembled configuration.

A latch 34 is provided on the frame at a location diametrically opposite from the hinge in relation to the mounting aperture for selectively latching the upper and lower portions of the frame in the closed position. The latch includes a finger member 36 integrally moulded with the upper portion of the frame to extend downwardly and overlap the lower portion of the frame opposite from the hinge. An inner protrusion 38 is formed on an inner side of the finger member where it overlaps the lower portion to define a first mating hook surface lying generally horizontally and perpendicular to the longitudinal direction of the stake in the closed position.

The latch further includes a recess 40 formed on the lower portion at an area overlapped by the finger member to define a second mating hook surface facing downwardly and away from the opposing portion of the frame in the closed position similarly to the first mating hook surface. The second mating hook surface is also perpendicular to the longitudinal direction such that when the first and second mating surfaces are engaged with one another in a latched position, the upper portion is prevented from being pivoted into the open position from the closed position by the mating surfaces which are hooked relative to one another. The finger of the latch is resilient such that the finger can be flexed outwardly and away from the lower portion in a radial direction to cause the first mating hook surface to be misaligned with the second mating hook surface and released therefrom in a released position of the latch. In the released position the upper portion of the frame is no longer restricted from being pivoted from the closed position to the open position.

The lower portion of the frame further includes a stem integrally moulded therewith to extend radially downward in the longitudinal direction of the stake member. A socket 44 is formed within the stem with a downward facing opening which is square in cross section similar to the stake member. The socket in the stem and the stake are arranged for relative sliding movement in the longitudinal direction of the stake as they are connected in a mated position supporting the frame on the stake. By suitably sizing the socket relative to the stake to provide an interference fit therebetween, the lower portion of the frame can be retained on the stake wholly by friction between the mating surfaces thereof.

Transverse apertures 46 are formed to extend fully through the socket between opposing sides of the body of the lower portion as well as to extend fully through the stake adjacent the top end thereof. The apertures extend perpendicularly to the longitudinal direction and are aligned with one another when the top end of the stake is received within the socket of the frame. A suitable retainer pin or screw can thus be inserted through the cooperating transverse apertures 46 to selectively retain the stake within the socket.

The upper portion of each frame includes a post 48 which is integrally moulded with the body of the upper portion. The post is square in cross section and is aligned co-axially with the socket of the corresponding lower portion to extend radially outward from the mounting aperture in the closed position in the longitudinal direction of the stake member. The post is square in cross section and has corresponding dimensions similar to the socket and the stake such that when a second frame of identical configuration is stacked above the first frame on the stake, the post of the first frame is matingly received within the socket of the second frame stacked thereon in a non-rotatable mating connection.

Figure 3:
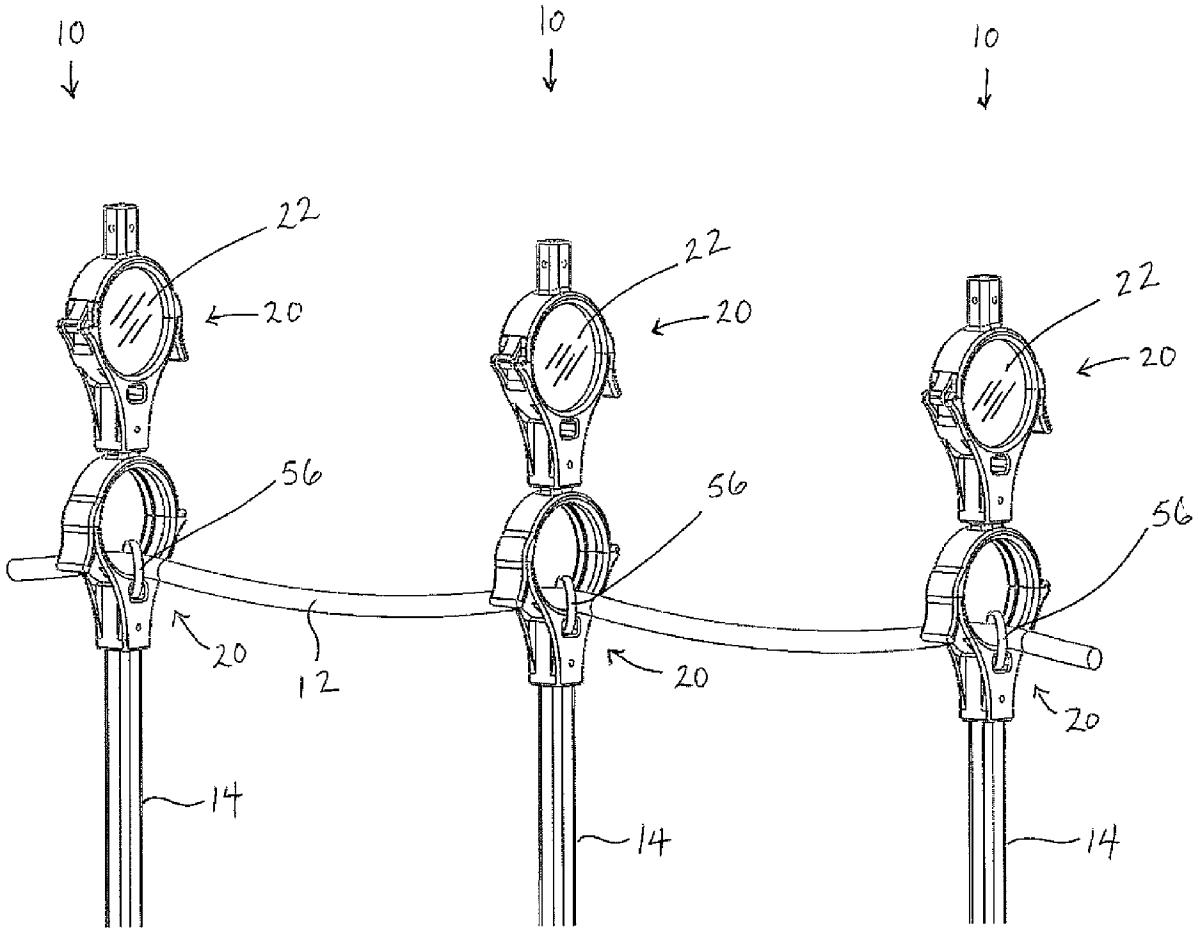
FIG. 3 is a perspective view of a row of marking devices of the marking system.
Figure 5:
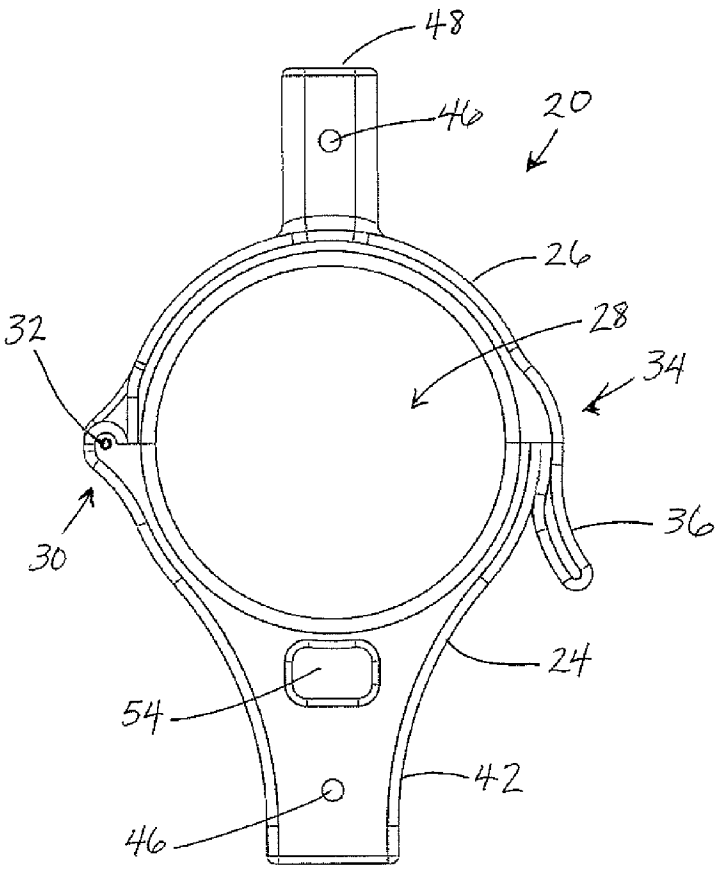
FIG. 5 is a front elevational view of one frame in the closed position.
Figure 4:
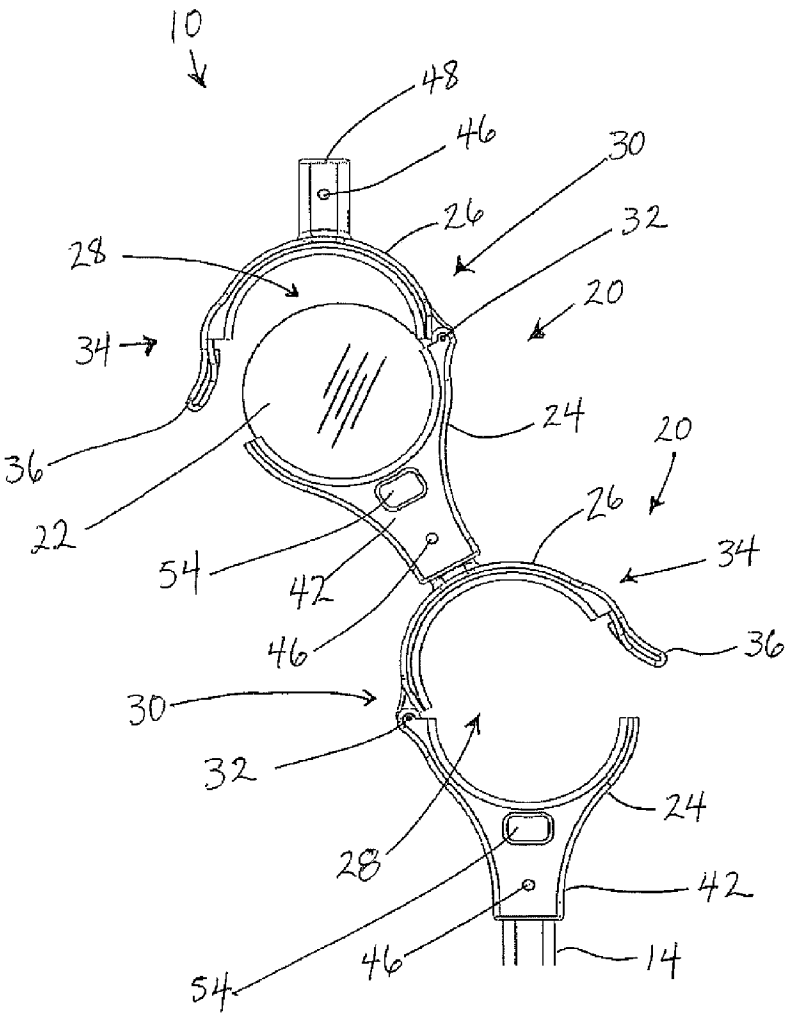
FIG. 4 is a perspective view of the two frames of FIG. 1 shown pivoted partway from the closed position to the open position.
Figure 9:
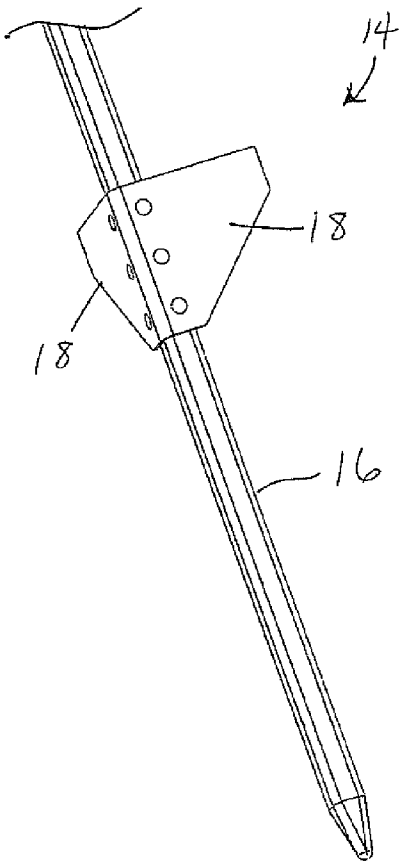
FIG. 9 is a perspective view of the bottom end of the stake member.
Figure 6:
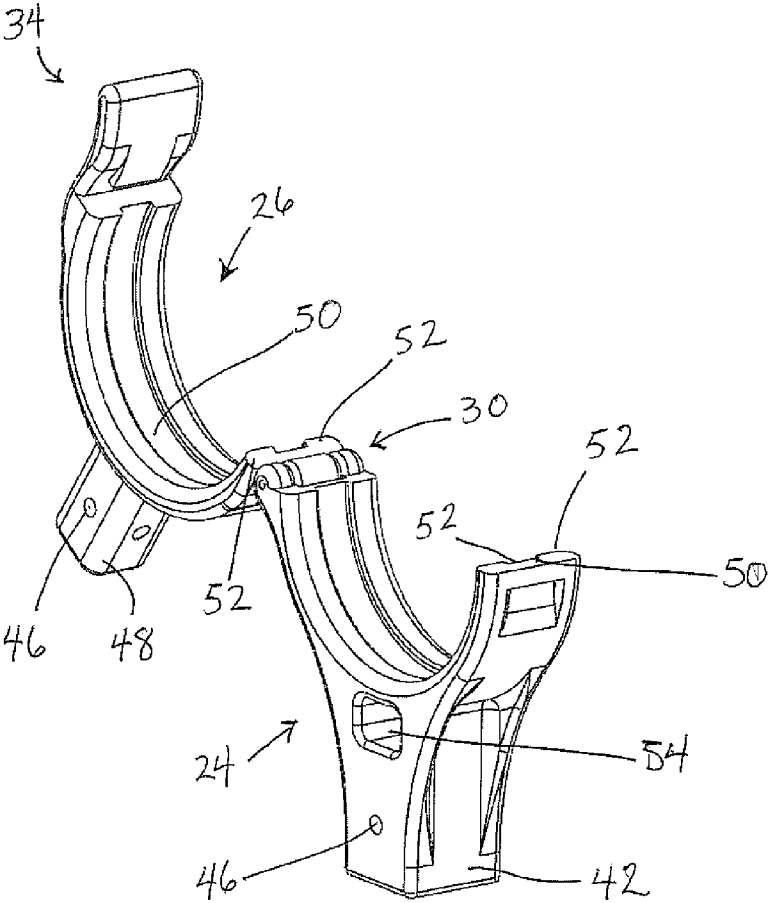
FIG. 6 is a perspective view of one frame in the open position.
Figure 8:
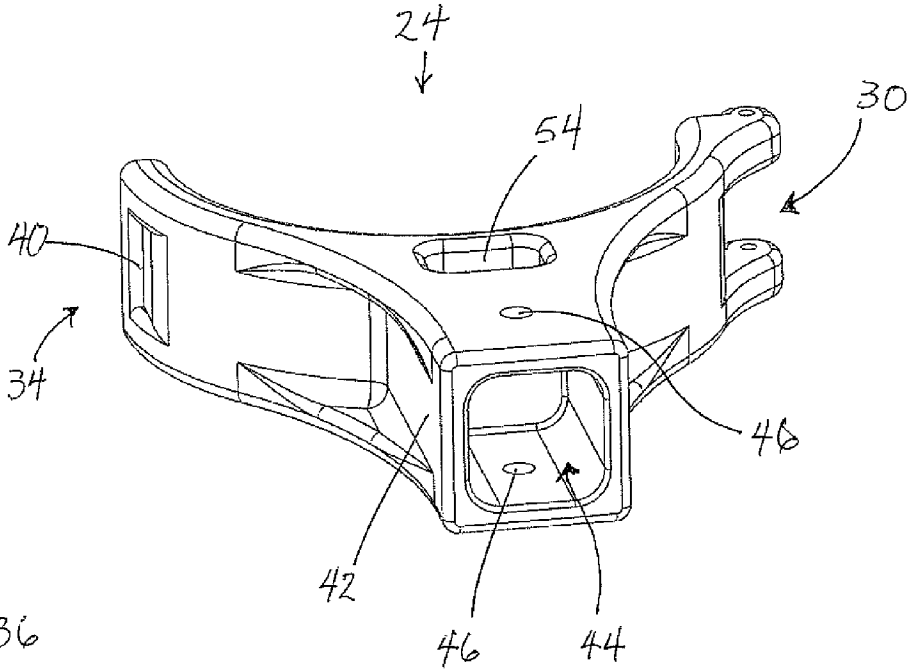
FIG. 8 is a perspective view of the lower portion of one frame.
Figure 7:
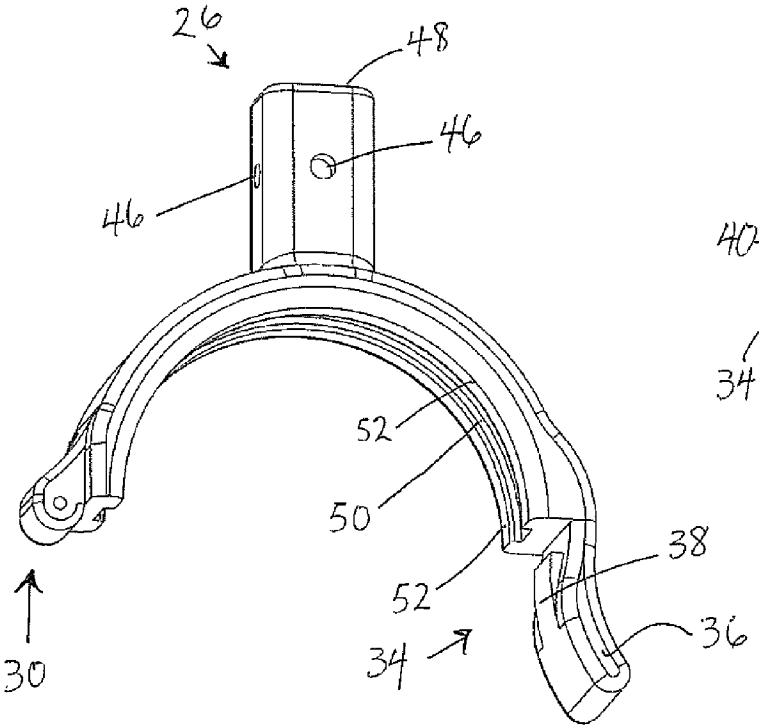
FIG. 7 is a perspective view of the upper portion of one frame.

The sizing of the posts relative to the sockets is similarly arranged for an interference fit such that the friction between the mating surfaces is sufficient to wholly retain the frames stacked relative to one another. Transverse apertures 46 are also provided in the post to extend in two perpendicular directions extending fully through the post between two opposing pairs of side walls. The transverse apertures 46 in the post align with the corresponding apertures in the socket of an adjacent frame of like configuration so that a retainer pin can similarly be received therethrough to retain two frames stacked relative to one another. The square cross section and the two sets of apertures within each post permit two adjacent frames to be mounted such that the planes of their mounting apertures are parallel as in FIG. 2 or perpendicular to one another as in FIG. 3 with transverse apertures being aligned in each instance.

Each of the upper and lower portions of the frame has a body including a semi-circular inner surface defining a respective portion of the periphery of the mounting aperture in the closed position. The semi-circular inner surface includes a central section 50 having an inner surface extending generally in the circumferential direction about the mounting aperture with a first radius of curvature corresponding approximately to the radius of the reflective member. The width of the central section 50 in the axial direction of the mounting aperture is also approximately equal to the corresponding thickness of the reflector between opposing flat circular sides thereof.

Each semi-circular inner surface of the upper and lower portions also includes two side sections 52 provided along opposing sides of the central section so as to be spaced apart from one another by the thickness of the reflector member. A radius of curvature of the inner edge of the two side sections corresponds to a second radius of curvature less than the first radius of curvature of the central section. The two side sections thus overlap the opposing circular side surfaces of the reflector member about the full periphery thereof to retain a reflector aligned within the central section of the upper and lower portions of the frame in the closed position.

Each frame further includes a retainer aperture 54 extending fully through the lower portion of the body between the mounting aperture and the socket in the closed position of the frame to extend generally in the axial direction of the mounting aperture between opposing sides of the body.

In a preferred use, a plurality of mounting devices are penetrated into the ground in a row along the edge of a driveway for example. Two frames are stacked together on each stake with a reflector member being retained in one of the frames, but the mounting aperture of the other frame being unoccupied by a reflector member. In the illustrated embodiment the planes of the mounting apertures of the two stacked frames of each device are oriented perpendicularly to one another. The cable member is then threaded through the unoccupied mounting apertures of the marking devices to extend along the row through all of the devices in series with one another.

In some instances, a plurality of flexible tie members 56 are provided with each tie member being inserted through the retainer aperture 54 of a respective one of the marking devices. After the cable member is threaded through the unoccupied mounting apertures of a row of devices 10, the tie members can be fastened and secured into respective loops in which each loop receives the cable member therethrough for tying the cable member to the lower portion of the respective frame as it extends through the mounting aperture.

The marking device described herein can be used as a support for extension cords, string, line, hose, caution/danger tape, holiday decorations or other related cable or strand type materials. The device also has a reflector to promote better visibility. The reflector can be removed if is not required and the opening can be used to hold more cords, etc. The modular design will make it possible to add additional frames if required. In this instance, the device assists in preventing people from tripping on extension cords, string, lines, hoses, and the like. Furthermore, extension cords wouldn't get hidden by fresh snowfall or plows and possibly get chewed up and tangled in snowblowers or damaged by shovels. Because this design keeps the electrical extension cord off the ground there is also a reduced risk of electrical short circuit due to ice, snow, and water contact.

This device can also be a huge asset when keeping extension cords sorted when charging the batteries on electric cars. This invention can also be used year round to run electrical cords to work projects in flower gardens and backyards and to mark walkways by running string or rope through it. Caution tape or any type of line could be run through the device to mark off small construction sites such as patios, sundecks, fishponds and other areas being landscaped to prevent personal injury. The device can also be used for decorative purposes simply by running strings of decorative lights or plastic streamers through the mounting apertures to decorate a yard for example.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A marking device for use with a reflector member, the device comprising:

a stake member which is elongate between a top end and a bottom end arranged for penetration into the ground; and a frame comprising:

a lower portion arranged to be supported on the top end of the stake member; and an upper portion arranged to be coupled to the lower portion such that the upper portion is movable relative to the lower portion between a closed position in which each of the lower portion and the upper portion extend partway about a periphery of a mounting aperture in the frame so as to be arranged to fully surround and retain the reflector member therein and an open position in which the mounting aperture is opened so as to be arranged to readily release the reflector member therefrom;

wherein the mounting aperture extends through the frame so as to be arranged to receive a cable extending through the mounting aperture in the frame in the closed position when the reflector member is removed from the mounting aperture.

2. The device according to claim 1 wherein the lower portion and the upper portion of the frame are coupled by a hinge such that the upper portion is pivotal relative to the lower portion between the open and closed positions.

3. The device according to claim 2 further comprising a latch arranged to selectively couple the upper portion to the lower portion at a location diametrically opposite from the hinge in relation to the mounting aperture.

4. The device according to claim 3 wherein the latch includes a finger member integrally moulded with one of the upper and lower portions of the frame and including a first mating hook surface thereon and wherein the other one of the upper and lower portions of the frame includes a second mating hook surface thereon arranged to be latched in relation to the first mating hook surface in the closed position, the finger member being resilient so as to be arranged to release the first and second mating hook surfaces from one another by flexing the finger member.

5. The device according to claim 1 wherein each of the lower portion and the upper portion are generally U-shaped about the mounting aperture.

6. The device according to claim 1 wherein the mounting aperture is circular and wherein each of the lower portion and the upper portion are generally semi-circular in shape about the mounting aperture.

7. The device according to claim 6 in combination with the reflector member in which the reflector member is circular, wherein each of the lower portion and the upper portion of the frame comprises a central section having a first radius of curvature which is substantially equal to a radius of the reflector member and a pair of side sections spaced apart by a thickness of the reflector member along respective sides of the central section and having respective second radii of curvature which are less than the first radius of curvature so as to retain the reflector member aligned with the central sections of the upper and lower portions of the frame in the closed position.

8. The device according to claim 1 further comprising:

the lower portion including a socket formed therein arranged to matingly receive the top end of the stake member therein;

the top portion including a post integrally formed thereon so as to be substantially coaxial with the socket in the closed position;

the post being arranged to be matingly received within the socket of an auxiliary frame of like configuration; and the post being sized relative to the socket for an interference fit therebetween such that the post is arranged to be retained within the socket of an auxiliary frame of like configuration wholly by friction of the mating connection therebetween.

9. The device according to claim 8 wherein the post and the socket have a non-circular cross-section such that the post is arranged to mate non-rotatably with the socket of the auxiliary frame.

10. The device according to claim 8 wherein the post is arranged to be matingly received within the socket of an auxiliary frame of like configuration for relative sliding movement in an axial direction and wherein the post and the socket of the frame have respective transverse apertures extending fully therethrough transversely to the axial direction so as to be arranged to receive a retainer pin through the post and the socket so as to retain the post within the socket of an auxiliary frame of like configuration.

11. The device according to claim 10 in combination with a plurality of marking devices of like configuration mounted at spaced apart positions in the ground and a cable member extending through the mounting apertures of the frames respectively, wherein each marking device further comprises:

a retainer aperture extending fully through the frame between opposing sides thereof which is independent of the mounting aperture; and a flexible tie member extending through the retainer aperture of each frame and being secured in a loop receiving the cable member therethrough.

12. The device according to claim 1 wherein the stake member further comprises a main body extending in a longitudinal direction between the top and bottom ends of the stake member and a pair of step flanges supported on the main body in proximity to the bottom end so as to project radially outward from the main body in relation to the longitudinal direction, the step flanges each comprising a flat plate having a top edge lying in a substantially common plane with the other flat plate and a bottom edge arranged for penetration into the ground, the flat plates being oriented transversely to one another.

13. A marking device for use with a reflector member, the device comprising:

a stake member which is elongate between a top end and a bottom end arranged for penetration into the ground; and a frame comprising:

a mounting aperture therein arranged to receive the reflector member therein such that the frame is arranged to fully surround and retain the reflector member therein;

a socket formed at a bottom side of the frame and arranged to matingly receive the top end of the stake member therein; and a post integrally formed at a top side of the frame so as to be substantially coaxial with the socket;

the post being arranged to be matingly received within the socket of an auxiliary frame of like configuration; and the post being sized relative to the socket for an interference fit therebetween such that the post is arranged to be retained within the socket of an auxiliary frame of like configuration wholly by friction of the mating connection therebetween.

14. The device according to claim 13 wherein the post and the socket have a non-circular cross-section such that the post is arranged to mate non-rotatably with the socket of the auxiliary frame.

15. The device according to claim 13 wherein the post is arranged to be matingly received within the socket of an auxiliary frame of like configuration for relative sliding movement in an axial direction and wherein the post and the socket of the frame have respective transverse apertures extending fully therethrough transversely to the axial direction so as to be arranged to receive a retainer pin through the post and the socket so as to retain the post within the socket of an auxiliary frame of like configuration.

16. A marking system comprising:

a plurality of marking devices of like configuration mounted at spaced apart positions in the ground, each marking device comprising:

a stake member which is elongate between a top end and a bottom end arranged for penetration into the ground;

a frame comprising:

a mounting aperture; and a retainer aperture extending fully through the frame between opposing sides thereof which is independent of the mounting aperture; and a cable member extending through the mounting apertures of the frames respectively;

a plurality of flexible tie members extending through respective ones of the retainer apertures of the frames, each being secured in a loop receiving the cable member therethrough so as to fasten the cable member to the frame.

17. The marking system according to claim 16 in combination with a plurality of circular reflector members wherein each mounting aperture is arranged to receive a respective one of the reflector members such that the frame is arranged to fully surround and retain the reflector member therein interchangeably with the cable member.

* * * * *